US010027061B2

(12) United States Patent
Avery et al.

(10) Patent No.: US 10,027,061 B2
(45) Date of Patent: Jul. 17, 2018

(54) SOCKET WITH INSERT-MOLDED TERMINAL

(75) Inventors: Hazelton P. Avery, Batavia, IL (US); Jerry D. Kachlic, Glen Ellyn, IL (US); David L. Brunker, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/002,159

(22) PCT Filed: Mar. 2, 2012

(86) PCT No.: PCT/US2012/027485

§ 371 (c)(1),
(2), (4) Date: Aug. 29, 2013

(87) PCT Pub. No.: WO2012/119075

PCT Pub. Date: Sep. 7, 2012

(65) Prior Publication Data

US 2013/0330969 A1 Dec. 12, 2013

Related U.S. Application Data

(60) Provisional application No. 61/448,517, filed on Mar. 2, 2011.

(51) Int. Cl.

| | |
|---|---|
| ***H01R 13/6461*** | (2011.01) |
| ***H01R 13/6599*** | (2011.01) |
| ***H01R 13/658*** | (2011.01) |
| ***H01R 13/405*** | (2006.01) |
| ***H01R 13/6587*** | (2011.01) |
| ***H01R 13/24*** | (2006.01) |

(Continued)

(52) U.S. Cl.

CPC ..... *H01R 13/6461* (2013.01); *H01R 13/2442* (2013.01); *H01R 13/405* (2013.01); *H01R 13/5045* (2013.01); *H01R 43/24* (2013.01); *H01R 13/6599* (2013.01)

(58) Field of Classification Search

CPC .... H05K 7/10; H01R 12/7076; H01R 12/714; H01R 9/096; H01R 13/6461; H01R 13/2442

USPC ..... 439/83, 874, 876, 607.1, 66

See application file for complete search history.

(56) References Cited

U.S. PATENT DOCUMENTS 6,932,618 B1 * 8/2005 Nelson ..... 439/66
6,945,788 B2 * 9/2005 Trout ..... H05K 7/1069 439/66

(Continued)

FOREIGN PATENT DOCUMENTS

EP 1531653 B1 * 1/2009
EP 2093576 A1 * 8/2009

(Continued)

OTHER PUBLICATIONS

International Search Report for PCT/US2012/027485 dated Sep. 25, 2012.

*Primary Examiner* — Renee Luebke
*Assistant Examiner* — Paul Baillargeon
(74) *Attorney, Agent, or Firm* — Jeffrey K. Jacobs

(57) ABSTRACT

A socket includes a housing that supports terminal bricks that can contain one or more terminals. The terminal bricks are inserted into apertures in the housing. The location of the terminal bricks can be adjusted separate from a side of the housing, thus providing the potential to improve coplanarity of the terminals in the socket.

16 Claims, 15 Drawing Sheets

(51) Int. Cl.
*H01R 13/504* (2006.01)
*H01R 43/24* (2006.01)

(56) References Cited

U.S. PATENT DOCUMENTS

| | | | | |
|---|---|---|---|---|
| 7,201,587 | B1 | 4/2007 | Eichorn et al. | |
| 7,651,382 | B2 * | 1/2010 | Yasumura et al. | 439/862 |
| 8,366,452 | B2 | 2/2013 | Yeh | |
| 2005/0196987 | A1 * | 9/2005 | Shuey | H01R 13/6477 439/108 |
| 2009/0111325 | A1 * | 4/2009 | Ju | 439/607.55 |
| 2009/0325401 | A1 * | 12/2009 | Sakairi et al. | 439/66 |
| 2010/0087075 | A1 * | 4/2010 | Kazama et al. | 439/85 |
| 2010/0267257 | A1 | 10/2010 | Yeh et al. | |

FOREIGN PATENT DOCUMENTS

| | | | |
|---|---|---|---|
| JP | 11-214068 | A | 8/1999 |
| KR | 10-2009-0044363 | A | 5/2009 |
| WO | WO 01/39332 | A1 | 5/2001 |

* cited by examiner

SOCKET WITH INSERT-MOLDED TERMINAL

RELATED APPLICATIONS

This application is a national phase of PCT Application No. PCT/US2012/027485, filed Mar. 2, 2012, which in turn claims priority to U.S. Provisional Application No. 61/448,517, filed Mar. 2, 2011, which is incorporated herein by reference in its entirety.

FIELD OF THE INVENTION

The present invention relates the field of connectors, more specifically to the field of connector suitable for use in socket applications.

DESCRIPTION OF RELATED ART

Socket connectors, such as those connectors that are typically used for mounting a central processing unit (CPU) package to a circuit board, are known. Typically the socket connector includes a frame with an array of apertures and the apertures can each support a terminal. The terminal typically has a tail that is configured to be mounted via a surface mount technology (SMT) attach to a circuit board that is positioned on a first side of the frame and the terminal has a contact portion that is accessible on a second side of the frame for engaging a mating structure (such as a CPU package). Because of a desire to control the position of the terminal in the frame, the terminal tends to have a large body portion that can be pressed into the aperture of the frame. Because of the desire for a large number of communication lanes, a large number of terminals are often provided in a relatively small area.

Socket connectors tend to be configured for one of two basic constructions, pin grid array (PGA) and land grid array (LGA). A socket configured to function with a PGA package is configured to receive pins provided on a mating surface of the CPU package. One issue with this configuration is that the pins on the PGA CPU package can be damaged and because the CPU is typically the most expensive part of the assembly, this makes the high value portion of the final assembly undesirably susceptible to damage during installation. In addition, if a zero insertion force (ZIF) connection is desired, the terminals have to be sized to allow the pins from the CPU to be inserted into a first position and then translated into a second position that causes the pins to engage the terminals, thus requiring larger terminals.

To avoid some of the problems provided by the PGA design, the LGA package configuration uses a pad on the mating surface of the CPU package and the socket terminals that engage the pads have a flexible arm that is configured to contact the pads. The LGA package can thus be placed gently on the terminals and then translated downward so that a reliable electrical connection takes place between the terminal arm and the pad on the CPU. However, because the terminal in the socket must still be inserted into an aperture from above due to the contact and flexible arm extending out away from the aperture and the fact that the tail of the LGA terminal tends to be configured so as to be SMT attached via a solder ball, the LGA terminal tends to have a large body portion that can securely support the terminal in the aperture.

As can be appreciated, the above issues tend to restrict the density that is possible in spite of the fact that CPUs can continued to shrink in size due to the application of Moore's Observation (e.g., the decrease in feature size and/or cost of transistors that make up the CPU). This issue is potentially particularly problematic for portable devices as they are expected to provide higher levels of computing performance while needing to be small if they are going to be truly portable. Furthermore, the existing terminal designs are not always configured to be efficient at lower voltage levels and higher data rates. Therefore, certain individuals would appreciate an improved CPU socket design.

BRIEF SUMMARY

A socket includes a housing with terminals mounted in apertures provided in the housing. The terminals are provided as insert-molded terminal bricks that can contain one or more terminals supported by a support block. Apertures in the housing thus receive the support blocks and allow the terminals to be held in place by controlling the position of the support block with respect to the frame and/or another datum. In an embodiment, the terminals can be configured to engage pads on a LGA-style CPU package. The housing can include conductive materials that provide shielding to help reduce cross talk between terminals.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
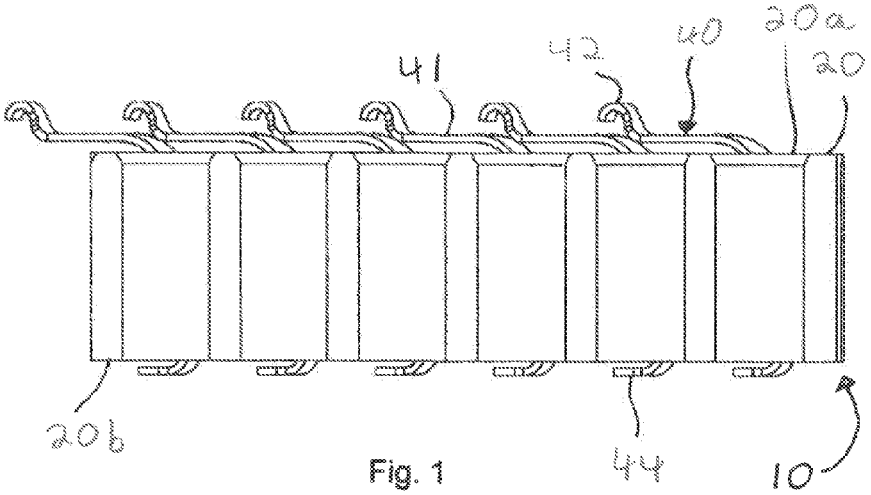
FIG. 1 illustrates an elevated side view of an embodiment of a socket assembly.
Figure 2:
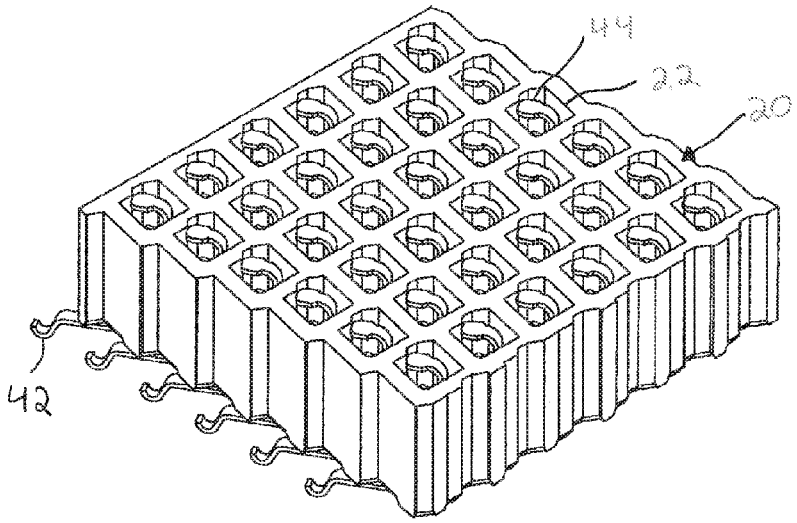
FIG. 2 illustrates a perspective view of the embodiment depicted in FIG. 1.

The detailed description that follows describes exemplary embodiments and is not intended to be limited to the expressly disclosed combination(s). For example, as can be appreciated, embodiments can readily be imagined that would combine feature of one embodiment with features of another embodiment disclosed herein. Therefore, unless otherwise noted, features disclosed herein may be combined together to form additional combinations that were not otherwise shown for purposes of brevity.

FIGS. 1-9 illustrate an embodiment that includes a plurality of terminal bricks 40 that each support a single terminal 41. Specifically, housing 20 includes a plurality of apertures 22 and terminal bricks 40 can be inserted into the apertures. The terminal bricks 40 include a terminal 41 that is insert molded into a support 46 that is insulative. The terminal 41 includes a body 48 that is partially contained within the support 46 and includes a contact 42 on an arm 43 on a first side A and a tail 44 on a second side B. The tail 44 can be supported by a compliant section 47 that helps address tolerance issues if desired. However, as can be appreciated, arm 43 is suitable to address the majority of tolerance issues.

Figure 3:
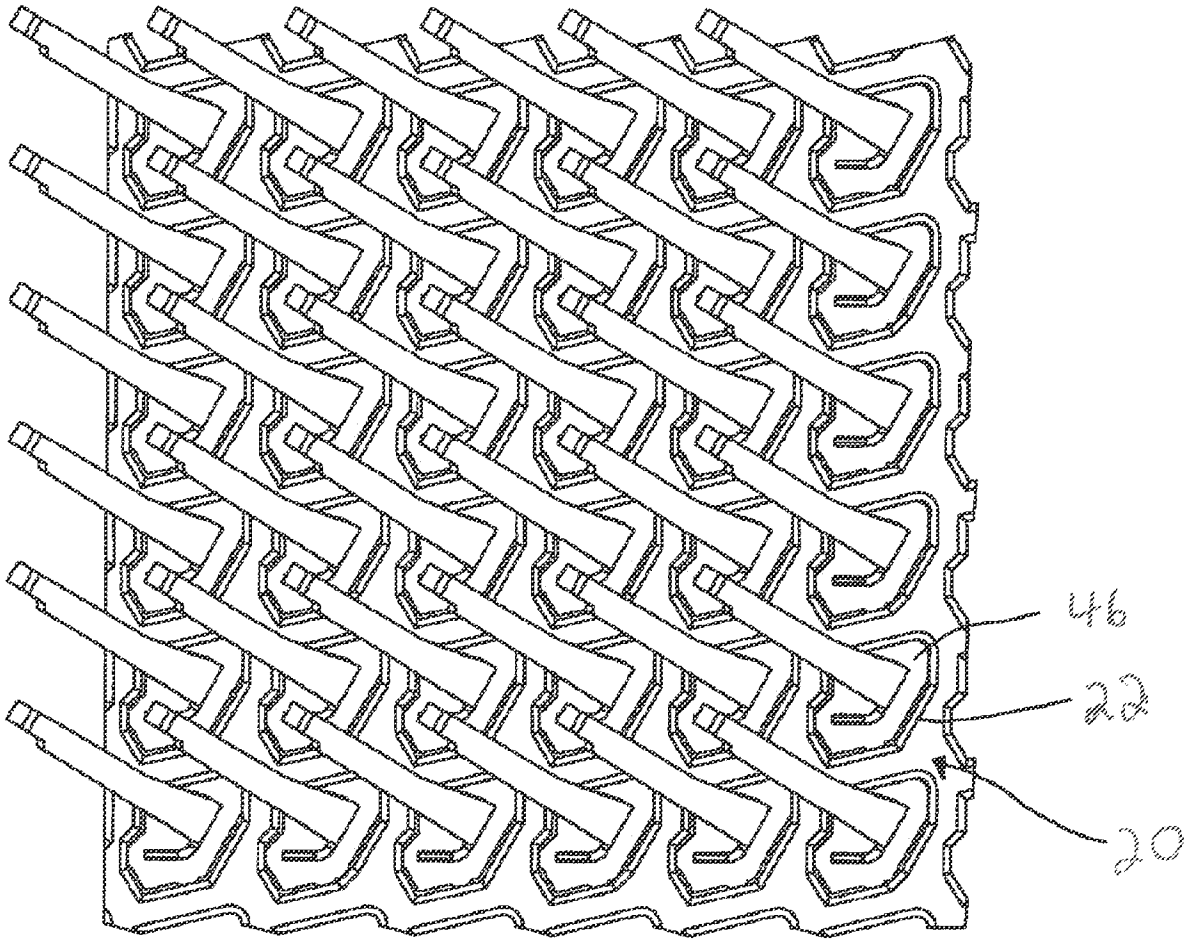
FIG. 3 illustrates a plan view of the embodiment depicted in FIG. 1.
Figure 4:
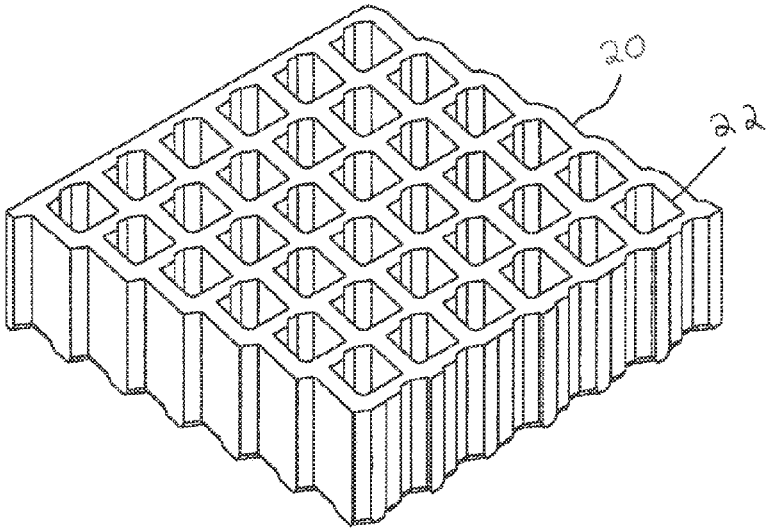
FIG. 4 illustrates a partially exploded perspective view of the embodiment depicted in FIG. 1.
Figure 4:
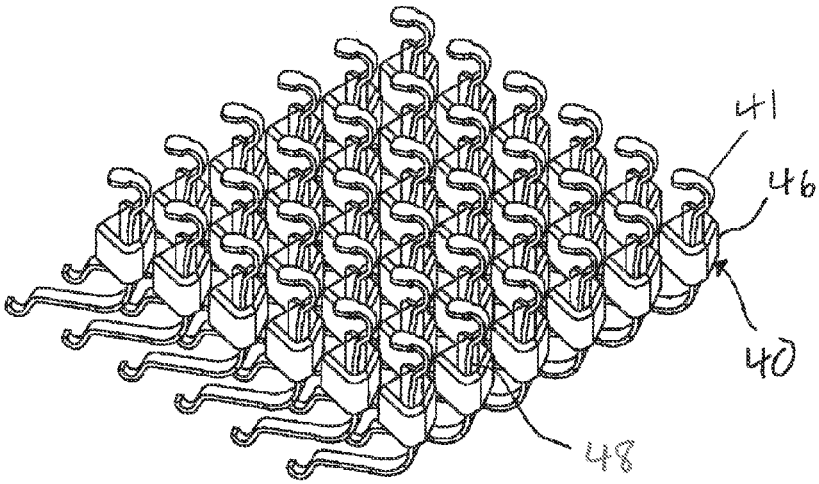

As can be appreciated from FIG. 3, if the aperture 22 is considered to extend in a first direction then the arm 43 extends transversely to that direction. As depicted, the arm 43 is configured so that the contact 42 is aligned with the body 48 of an adjacent terminal 40. As can be appreciated, the distance the contact extends transversely from the aperture may vary depending on a number of factors. Furthermore, in certain embodiments it may be desirable to have the contact aligned with the body (for example, if the mating contact was configured as a blade rather than a pad as is common on LGA configured ICs). However, for certain socket designs the arm 43 will extend such that the contact 42 will be positioned so that it is more closely aligned with an adjacent terminal body than the terminal body that supports the arm.

One benefit of the depicted design is that it provides flexibility in how the desired coplanarity is provided. For example, because the support 46 can be an insulative material and can be formed in highly repeatable manner on the terminal, the support 46 can be positioned in the housing 20 so that it pressed against a stop feature in the housing 20 (such as a ledge or projection) or could be made flush with one side of the housing in an alternative embodiment so as to allow for a coplanar arrangement of an array of terminals that are typically supported by the housing.

In certain embodiments the thinness of the housing 20 (or the materials used) may result in some small amount of warping that would make the housing 20 itself lack a desired level of coplanarity. As can be appreciated, a close alignment between terminal bricks 40 and the housing 20 would tend to propagate such a lack of coplanarity. In such an embodiment, the terminal bricks 40 could be pressed into the housing 20 in a manner that would provide for independent alignment of the terminal bricks 40 compared to the housing 20. In such an embodiment, the terminal bricks 40 would not need a predetermined alignment feature in the housing 20 (e.g., the housing could omit the stop feature) but instead could be pressed and have an interference fit with the housing 20. For example, an insertion tool could be configured to align the terminal bricks 40 separately from the housing 20 (but to a desired datum), thus the accuracy of the insertion tool and/or datum would be limiting factor in how well the resultant terminal array met any coplanar design criteria. As can be appreciated, such a configuration should provide improved tolerances because the insertion tools and/or datum would not need to be subject to variable warpage common with insert-molded parts (particularly molded parts that are cover a larger area).

As can be appreciated, an advantage of the embodiments depicted in FIGS. 1-9 is that the terminals can be used as desired (e.g., for power and/or communication). As depicted, each terminal is separately formed into a terminal brick that includes a support block and the terminal. Because the support block can be used to support the terminal in the frame (as opposed to conventional designs where the terminal body is required to be fully engage and position the terminal in an aperture), the terminal body portion can be made much smaller. This allows for reduced impedance discontinuities, which can provide a benefit of reducing the amount of reflected energy (thus allowing the chip to function at lower power and waste less energy).

Figure 10:
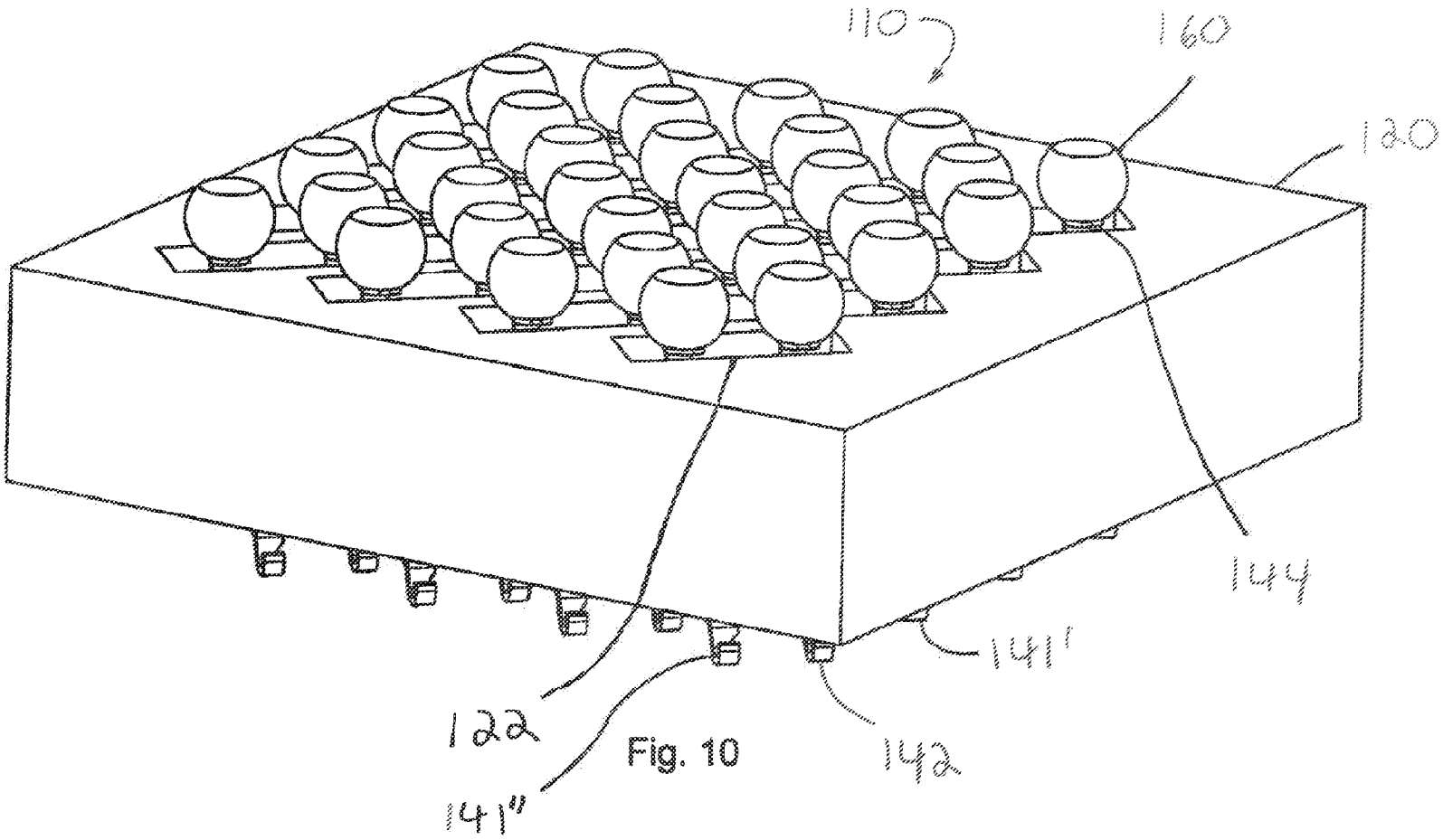
FIG. 10 illustrates a perspective view of an embodiment of a socket assembly.
Figure 11:
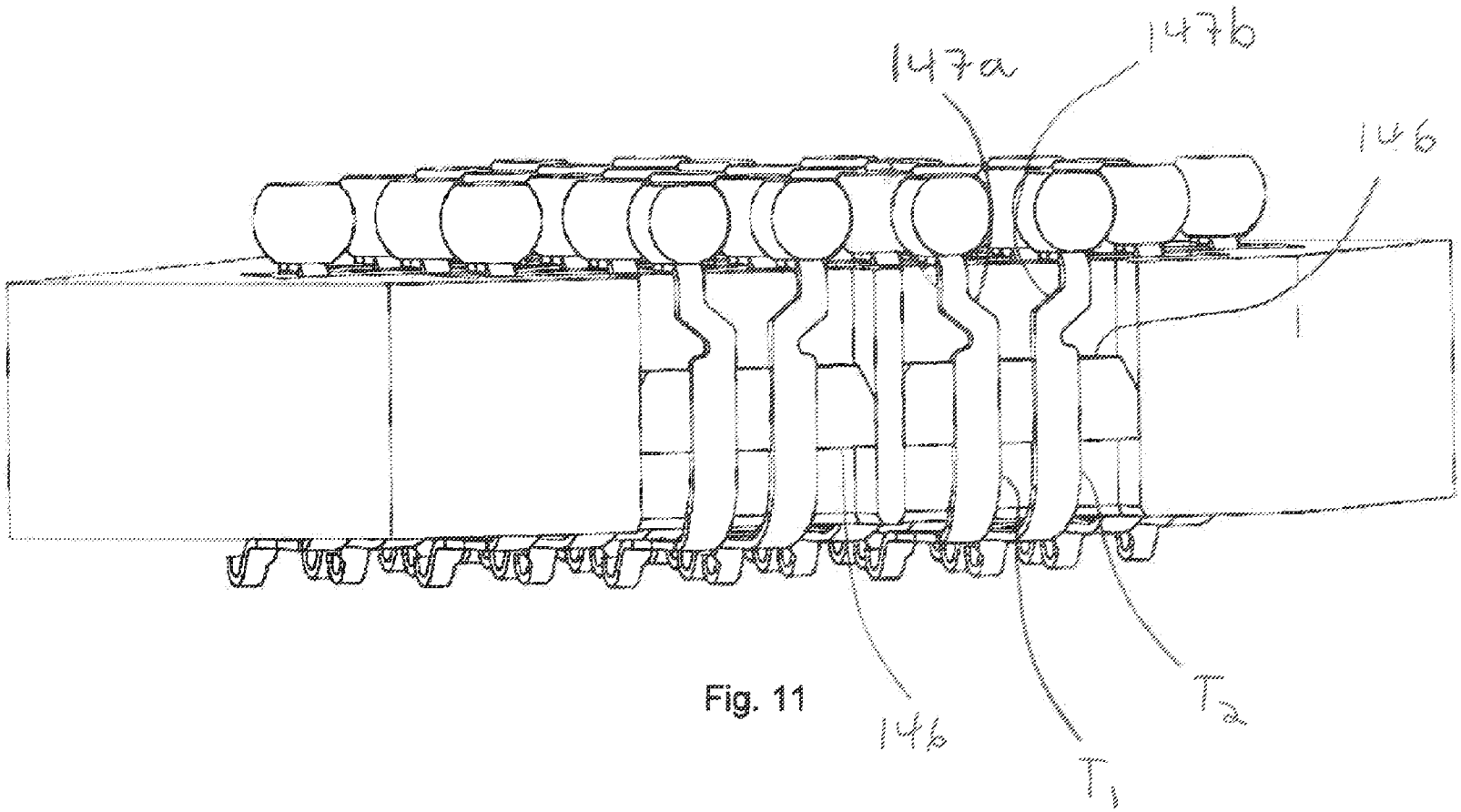
FIG. 11 illustrates an elevated side view of a cross-section of the embodiment depicted in FIG. 10.
Figure 12:
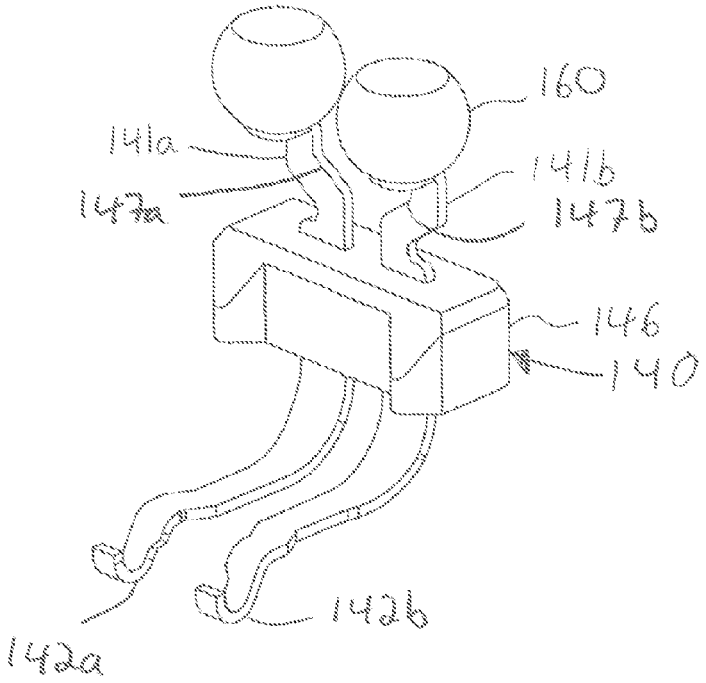
FIG. 12 illustrates a perspective view of an embodiment of a terminal brick.
Figure 13:
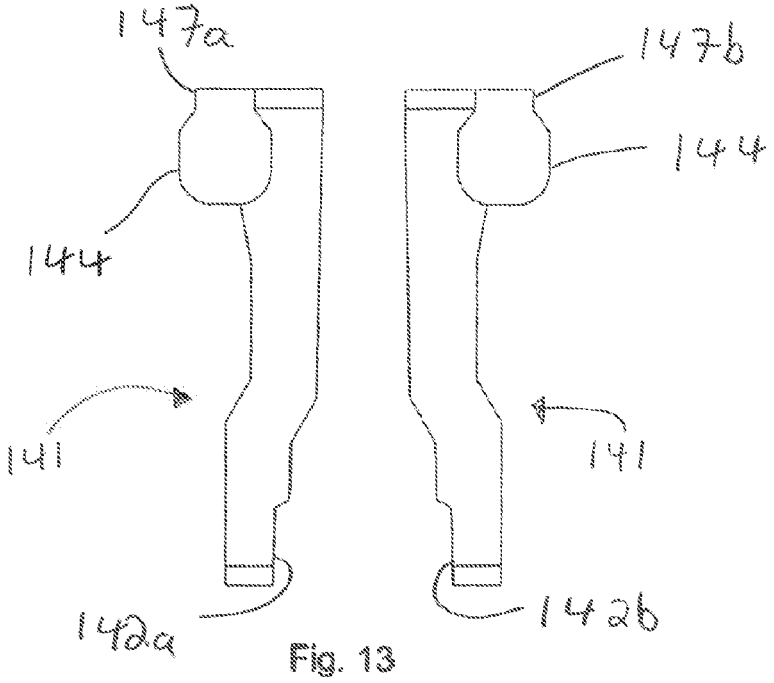
FIG. 13 illustrates an elevated side view of a pair of terminals that could be used in a terminal brick.

FIGS. 10-13 illustrate an embodiment of a socket 110 that includes a plurality of terminal bricks 140 position in apertures 122 that each support multiple terminals 141. As can be appreciated, while only two terminals 141*a*, 141*b* are shown as being supported by each support block 146, the support block 146 could be configured to support three or more terminals (e.g., a row of terminals) and the housing 120, as depicted in FIG. 10, could also be configured to support varying sizes of terminal bricks 140. For example, a housing could support some terminal bricks that each support a plurality of terminals while also supporting terminal bricks that support one terminal (as depicted in FIGS. 1-9). Thus, it is contemplated that a housing could be configured to support all the same sized terminal bricks or alternatively support different sized terminal bricks as desired.

An advantage of a configuration where each terminal brick supports multiple terminals is that the position of one terminal in the terminal brick relative to another terminal in the terminal brick can be controlled relatively precisely during manufacture of the terminal bricks. Thus, multiple terminals can be more readily optimized to provide a desired channel performance.

As will be discussed further below, the use of terminal bricks with multiple terminals (such as is depicted) allows for the ability to tune a pair of terminals so that they are preferentially coupled together (which can provide an improved differential signaling performance). This can be especially useful at higher data rates.

Furthermore, as can be appreciated, the pitch between the terminals in a terminal brick can be varied. Due to manufacturing tolerances of circuit boards and the desire to avoid bridging between soldered terminals, the ability to reduce the pitch of the tails is somewhat limited. This has acted to limit the pitch between terminals as well. While the issue of reducing the pitch of the tails is difficult to resolve without costly process and material changes, the effect of maintaining a consistent pitch in the tail has led to providing all terminals in the array at the same pitch from each other throughout their passage from the CPU to the board. This means that while it might be desirable to have a particular terminal only couple to one of the adjacent terminals (the desired mode), the comparable proximity of the other terminals will tend to lead to a number of undesirable or unintended modes and an increased level of cross-talk.

With the embodiment depicted in FIGS. 10-13, however, a substantial portion of the distance between the tail and the contact can be configured so that the terminals that are intended to form a differential pair are closer in electrical proximity vis-a-vis other terminals in the frame. This can lead to reduced cross talk as the pair of terminals, if used to provide a differential signal channel, are less likely to form undesirable modes with other terminals and any energy carried on the other terminals that results from such an unintentional mode should be reduced (which is expected to reduce cross-talk).

It should be noted that while a solder ball surface mount technology (SMT) attach system is depicted, a terminal with a tail that is configured to be mounted via SMT attach so as to form what is sometimes referred to as butt joint could also be used. Of course the terminals could also be configured as tails designed to be inserted into a via but, due to the desired density and number of terminals, it is often determined to be beneficial to use SMT to mount the terminals to the circuit board rather than attempt to route out the signal traces from vias.

Figure 5:
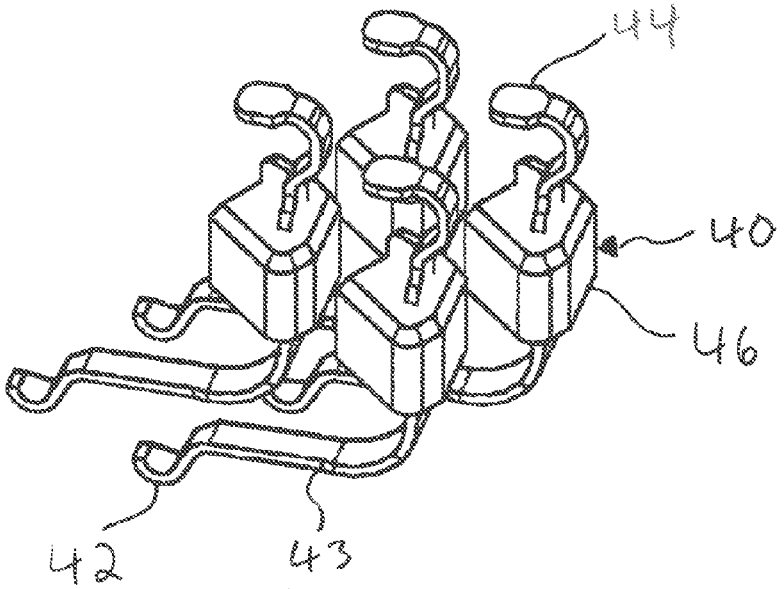
FIG. 5 illustrates an enlarged perspective view of four terminals bricks.
Figure 6:
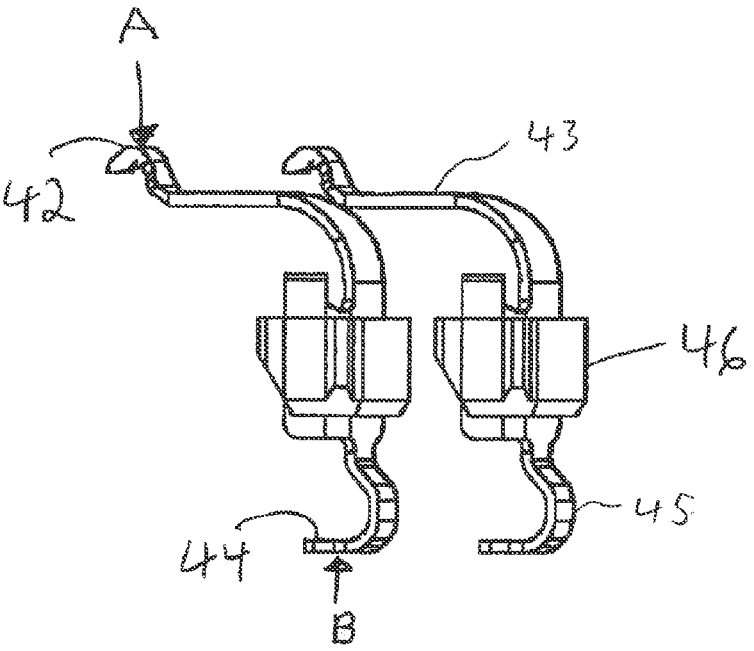
FIG. 6 illustrates an elevated side view of the terminals depicted in FIG. 5.
Figure 7:
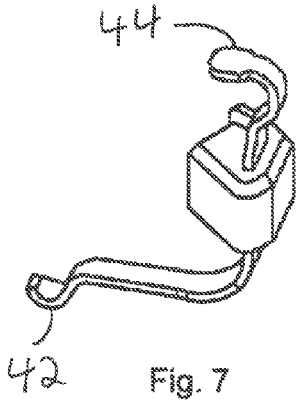
FIG. 7 illustrates a perspective view of an embodiment of a terminal assembly.
Figure 8:
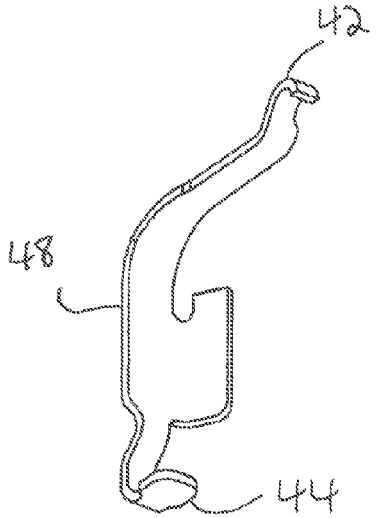
FIG. 8 illustrates a perspective view of an embodiment of a terminal.
Figure 9:
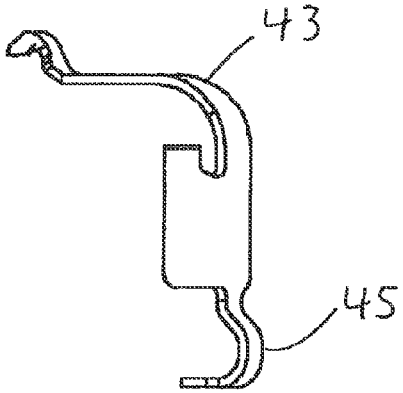
FIG. 9 illustrates a side view of an embodiment of a terminal.
Figure 14:
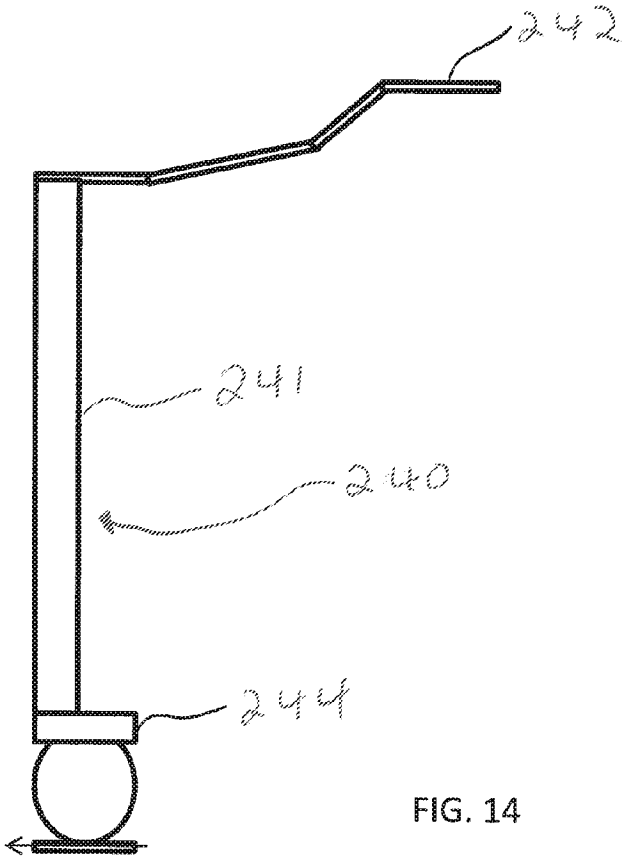
FIG. 14 illustrates a schematic representation of a terminal that could be used in a socket configuration.
Figure 15:
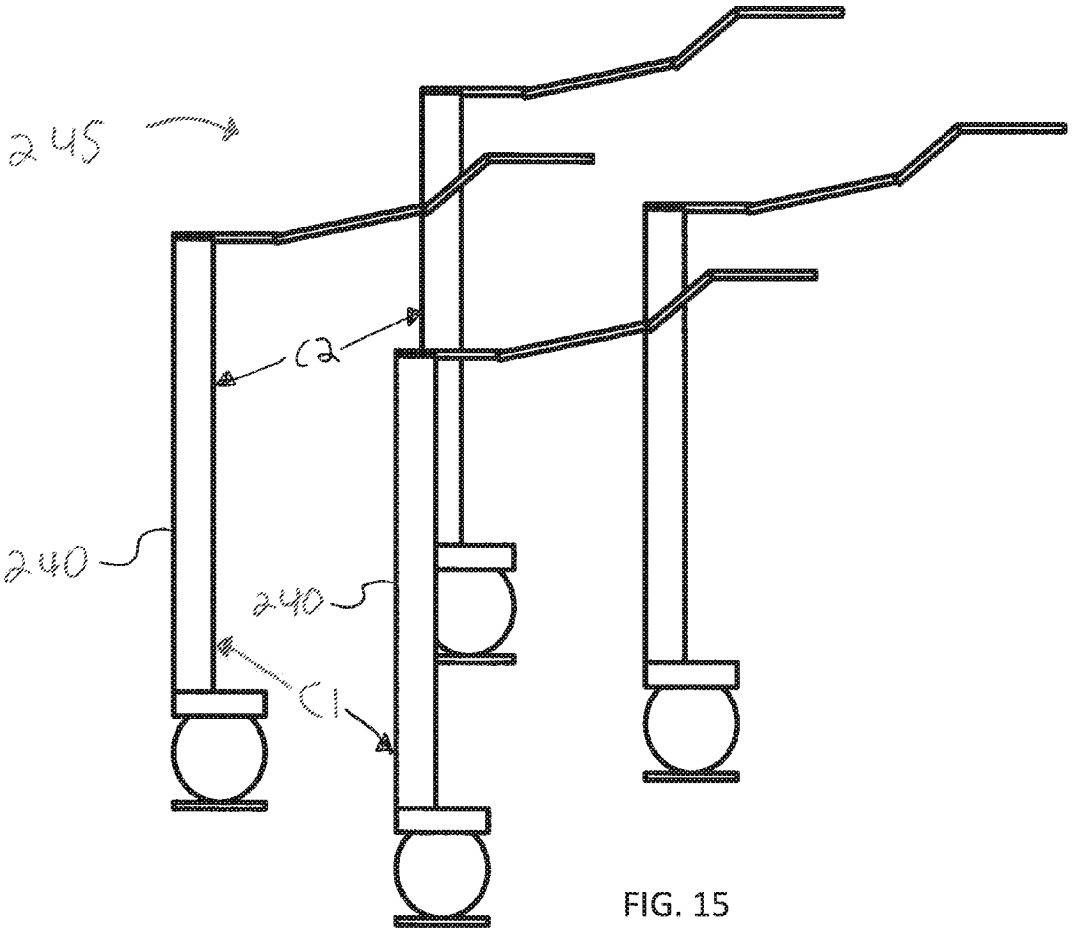
FIG. 15 illustrates a schematic representation of an array of terminals that could be used in a socket assembly.
Figure 16:
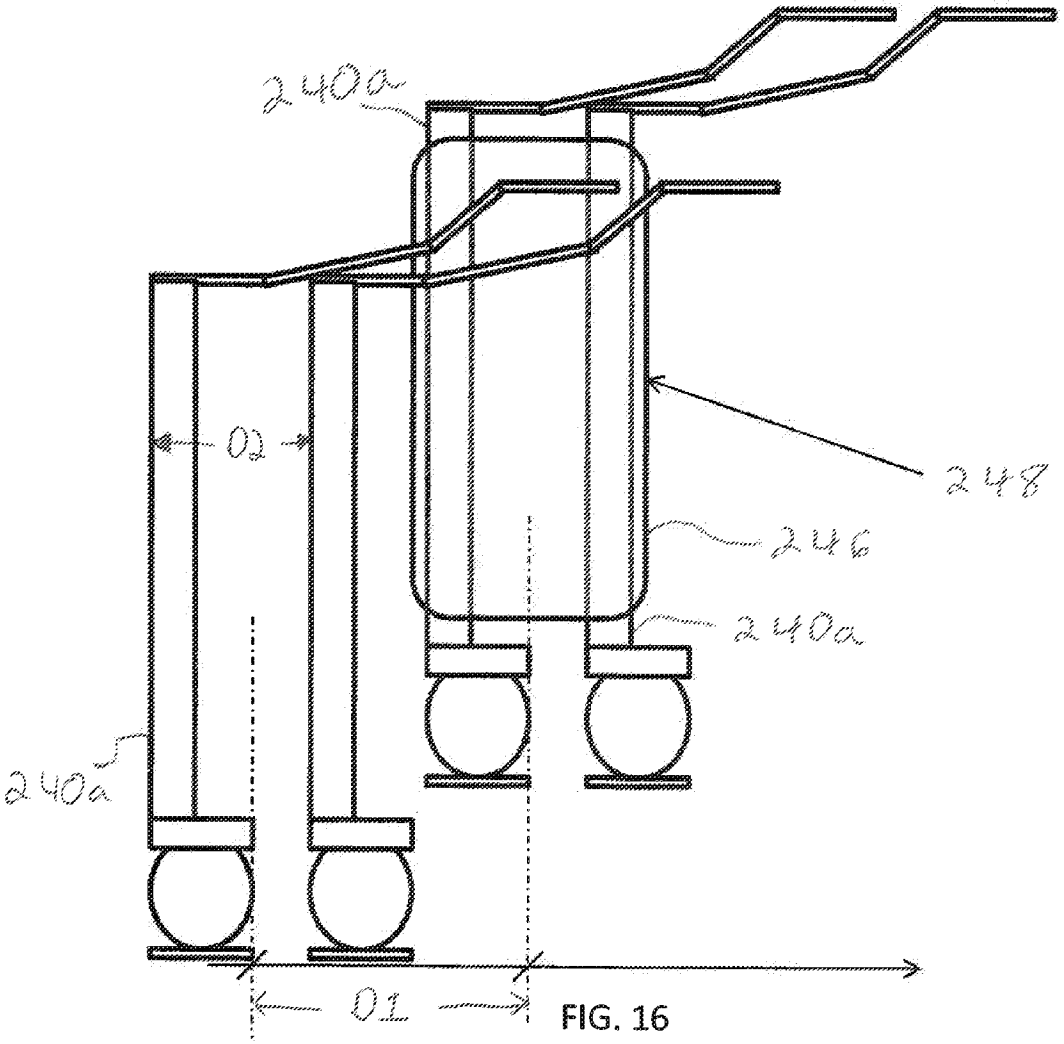
FIG. 16 illustrates a schematic representation of an array of terminal bricks, one being simplified.
Figure 17:
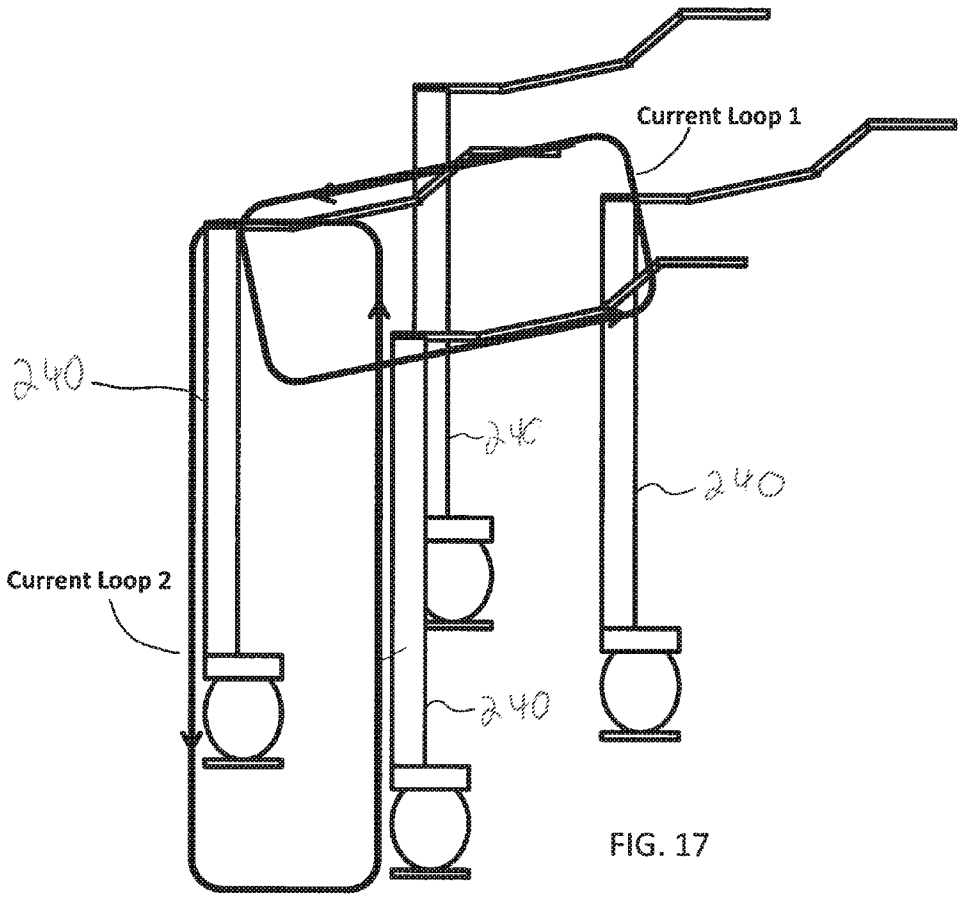
FIG. 17 illustrates a schematic representation of an electrical coupling between two terminals from the embodiment depicted in FIG. 15.
Figure 18:
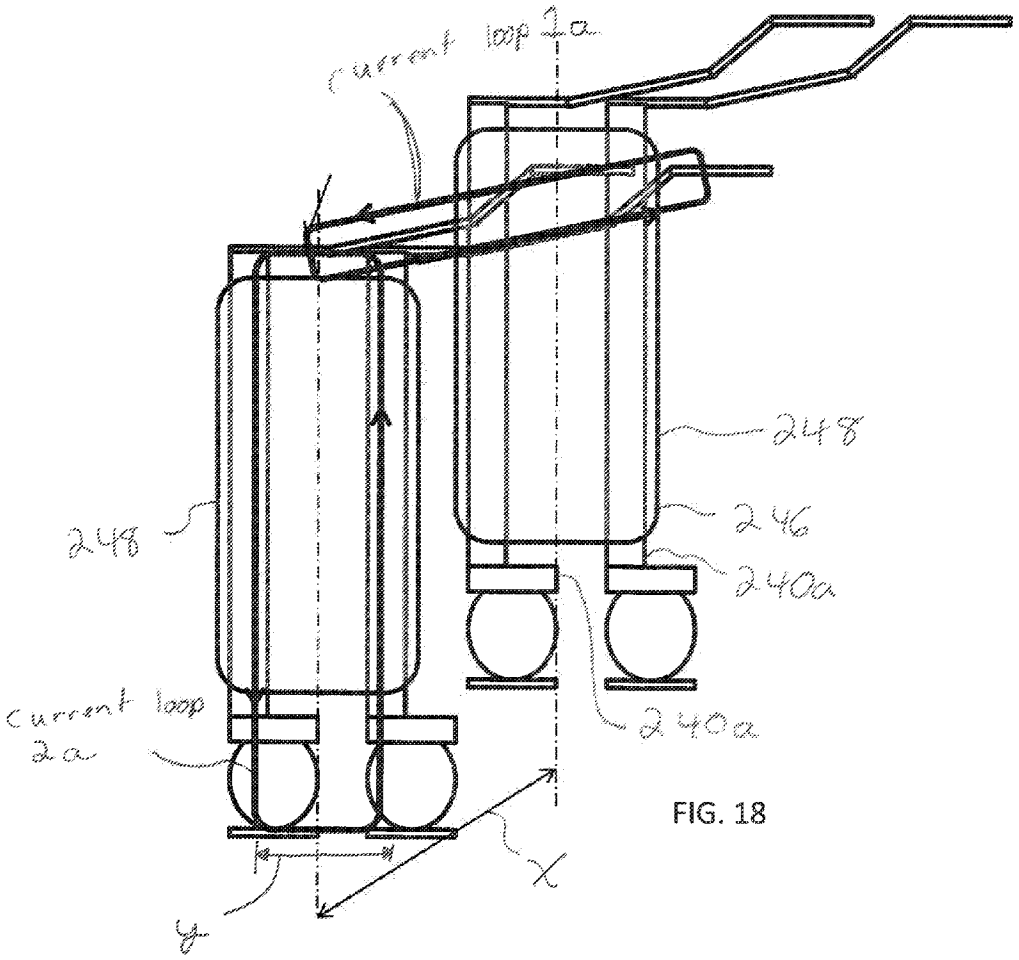
FIG. 18 illustrates a schematic representation of an electrical coupling between two terminals from the embodiment depicted in FIG. 16.

FIGS. 14-19 illustrate schematic representation of terminal configurations. FIGS. 14 and 15 illustrate schematic representations of a terminal and terminal system where the terminals are not coupled together in a paired manner. Thus, each terminal assembly 240 (which could be a terminal brick such as is depicted in FIG. 5) includes a terminal 241, a tail 244 and a contact 242. As can be appreciated, a distance C1 between two terminals can be the same as the distance C2 (e.g., the terminals can be on a constant pitch). FIG. 16 illustrates a schematic representation where terminals are paired to form terminal bricks 248. Each terminal brick 248 includes two terminals 240*a* supported by a support block 246. Thus, pairs of terminals that are each a distance D1 from each other can be positioned so that each terminal in the pair is a distance D2 apart, where D2 is less than D1. As can be appreciated from a comparison of FIGS. 17 and 18, in an embodiment where the terminals function as a differential coupled signal pair, the current loop 1 and current loop 2 are larger than current loop 1*a* and current loop 1*b*. This allows for the terminals that are paired to provide reduced loop inductance as compared to terminals that are not both part of the pair. In other words, within a coupled pair the differential impedance can be set lower than the differential impedance between one of the terminals in the terminal pair and a terminal outside the terminal pair.

Typically paired terminal configurations are defined by design and/or by function. As noted above, by design a paired terminal configuration can establish tighter geometric coupling within a given pair than across pairs. By function, paired terminal configurations establish tighter electrical coupling within a given pair than across pairs. A doublet version can comprise a 2-conduction version with a dielectric containment that allows a single mechanical datum to be used to orientate the terminals in a connector. In such a configuration, the pitch progression can be defined as pair-to-pair pitch progression.

Figure 20:
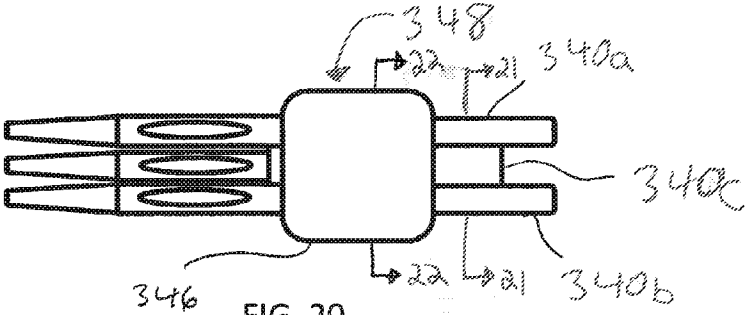
FIG. 20 illustrates a schematic representation of another embodiment of a terminal brick.
Figure 23:
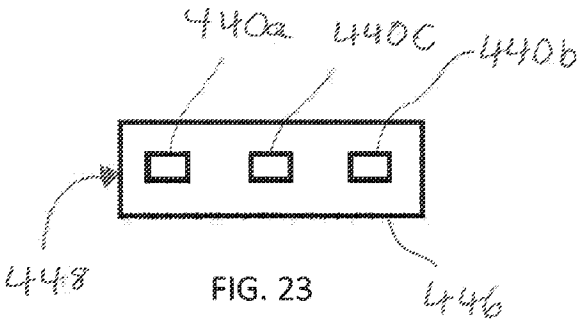
FIG. 23 illustrates a cross section of another embodiment of a terminal brick.
Figure 21:
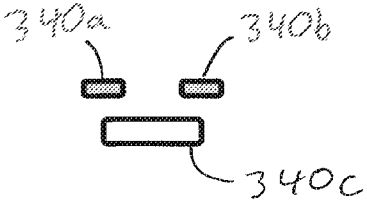
FIG. 21 illustrates a cross-section of the terminal brick depicted in FIG. 20, taken along line 21-21.
Figure 22:
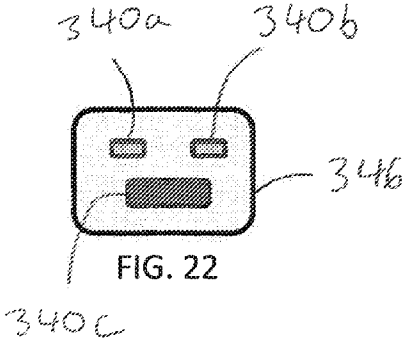
FIG. 22 illustrates a cross-section of the terminal brick depicted in FIG. 20, taken along line 22-22.

While a simple pair construction may be sufficient, for systems that require greater performance a three terminal system may also be desired. Such a system could include two signal terminals and one ground terminal and an embodiment is illustrated in FIGS. 20-22. A terminal brick 348 includes first terminal 340*a*, a second terminal 340*b* and a third terminal 340*c* supported by a support block 346. As can be appreciated, the terminal 340*c* (which is configured to function as a ground terminal) is positioned so as to be broadside coupled to a pair of terminals 340*a*, 340*b* that are configured to provide an edge-coupled differential terminal pair. Such a system could be provided by forming the signal pairs in a first molding operation and then positioning the ground terminal in a second molding operation (e.g., a two-shot molding process). In another embodiment, the ground terminal could be positioned between the two signal terminals (although this may intend to increase the amount of energy transmitted on the ground terminal). Such a system is depicted in FIG. 23 and includes a terminal brick 448 that includes a signal terminal 440*a* that differentially couples to a signal terminal 440*b* and includes a ground terminal 440*c* between the two signal terminals. As can be appreciated, such a system would be simpler to manufacture but may be slightly more challenging to tune for extremely high frequency signaling (such as greater than 15 GHz).

In general, it is expected that a three terminal system could provide additional performance but would come at the cost of a more complex manufacturing process and the need for additional tooling. Thus a balance between the performance of a terminal brick and its subsequent cost will determine the level of features integrated into the terminal brick. As noted above, for certain applications it may be desirable to the housing configured to accept different types of terminal bricks. For example, terminals intended for the provision of high data rates but be configured as a pair or even a triplet while terminals intended to be used for power or signaling that requires a lower data-rate (such as providing clock signals) might be configured as discrete terminals or paired terminals that are not spaced closer together. It should be noted, however, that even power signals may benefit from pairing as the potential reduction in current loop impedance may be beneficial.

Figure 19:
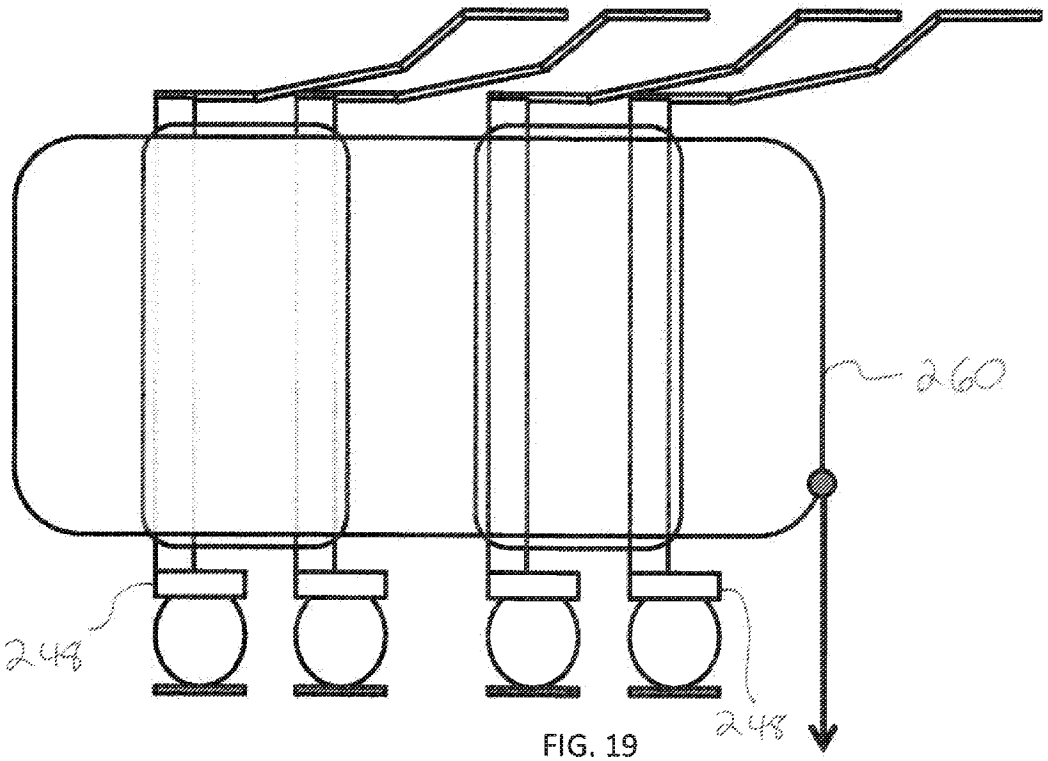
FIG. 19 illustrate a schematic representation of an embodiment of terminal bricks with an optional shield configuration.

FIG. 19 illustrates an embodiment where an additional feature of a shield 260 is provided. The shield 260 (which may be coupled to a ground plane) could be incorporated into one or more sides of the terminal brick (e.g., via a plating or second-shot molding process) or could be incorporated into the wall of the housing. For example, the housing could be formed of a conductive or semi-conductive material (which as long at the support block was insulative would not cause the terminals to short to each other) that could act to shield terminals from each other. As can be appreciated, the shielding could be selective (e.g., only between particular terminals), could be continuous (e.g., the entire housing could be so configured) or some combination of the two. Furthermore, if a two-shot molding process were used, some areas could be conductive while other areas could be purely insulative. If desired, shields could be insert-molded into particular areas of the housing. This would allow for selective shielding in the housing while providing selectively paired terminals. Thus the performance of the socket could be substantially improved compared to existing sockets. In an embodiment, for example, an aperture in the housing could have one side shielded and then have two separate terminal bricks inserted into the aperture. As can be further appreciated, the shielding could also be provided by a combination of including conductive layers (which could be a plating or a separate material or a second shot of material) on both the housing and terminal pairs. Thus there is substantial flexibility in how the shielding and paired terminals could be configured.

It should be noted that some of the depicted embodiments are directed toward sockets well suited to support CPU type integrated circuits (IC) that use an LGA configuration. However, the technology disclosed herein is not so limited. Sockets with terminal bricks inserted into a housing could readily support other types of ICs (such as those that include a PGA). In addition, by adjusting the tails and/or terminals, a socket could provide an interface suitable for engaging terminals provided by a mating connector. FIG. 20, for example, provides an interface that might be well suited to provide a socket that could function as a header (as is common in backplane and mezzanine style connector). Thus, the depicted embodiments are merely representative of particular embodiments and are not intended to be limiting unless otherwise noted.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A socket, comprising:

a housing with a first and second side opposite the first side and a first, a second and a third aperture extending from the first side to the second side, the first and second side spaced apart a first distance and each of the apertures having a perimeter; and a first terminal brick, a second terminal brick and a third terminal brick inserted, respectively, into the first, second and third apertures, each terminal brick including a support block with a third side and a fourth side and an outer surface that extends between the third and fourth side, the third and fourth side being spaced apart a second distance that is substantially less than the first distance so that the support block is fully enclosed by the housing on the outer surface and at least one pair of terminals supported by the support block, wherein the first terminal brick has less terminals than both the second terminal brick and the third terminal brick and each of the first, second and third terminal bricks has an even number of terminals, wherein the terminal bricks are inserted into the apertures to provide for a desired level of coplanarity and wherein each of the terminals includes a tail extending from the fourth side and an arm extending from the third side and extending out from the aperture on the first side and a body supported by the support block, the arm supporting a contact, wherein the arm extends in a transverse direction with respect to the aperture such that the contact extends toward and is more closely aligned with a body of an adjacent terminal and the tail extends from the support block in a manner such that the tail is aligned inside an area defined by the perimeter, wherein the bodies of the two terminals that form each of the pairs of terminals are offset toward each other compared to the tails of the two terminals, wherein the two terminals that form each of the pairs of terminals are configured so that they are closer to each other than either terminal is to an adjacent terminal along a substantial portion of a length of the arms.

2. The socket of claim 1, further comprising a shield configured to provide electrical isolation between a first pair of terminals and a second pair of terminals.

3. The socket of claim 1, wherein one of the housing and a terminal brick includes a conductive layer that is configured to decrease cross-talk between two pairs of terminals.

4. The socket of claim 3, wherein the housing is partially formed of a conductive plastic.

5. The socket of claim 3, wherein one side of a terminal brick includes a conductive layer.

6. The socket of claim 3, wherein both the housing and the terminal brick includes conductive layers that collective provides cross-talk shielding between a first and second pair of terminals.

7. A socket, comprising:

a housing with a first side and a second side and a first aperture and a second aperture and a third aperture extending from the first side to the second side; and a first terminal brick, a second terminal brick and a third terminal brick inserted, respectively, into the first, second and third apertures, each terminal brick including a support block that is completely positioned within the aperture between the first and second side and that supports a first terminal and a second terminal that form a terminal pair, wherein the terminal bricks are inserted into the apertures to provide for a desired level of coplanarity and wherein each of the terminals includes a tail extending from the second side, a body supported by the support block and an arm extending from the aperture on the first side, the arm supporting a contact, wherein the contacts of the first and second terminals are spaced apart and the arms of the first and second terminals are closer together than the contacts along a substantial portion of the arms, wherein the third terminal brick has more terminal pairs than the second terminal brick and the second terminal brick has more terminal pairs than the first terminal brick and each of the first, second and third terminal bricks has an even number of terminals.

8. The socket of claim 7, wherein the arm extends transversely to a direction aligned with the aperture such that the contact is more closely aligned with a body of an adjacent terminal than the body of the supporting terminal.

9. The socket of claim 7, wherein the terminal bricks are configured to be inserted into the apertures with an interference fit.

10. The socket of claim 9, wherein the housing does not include a stop feature.

11. The socket of claim 7, wherein one of the housing and a terminal brick includes a conductive layer that is configured to decrease cross-talk between two pairs of terminals.

12. The socket of claim 7, wherein a portion of the housing is formed of a conductive plastic.

13. The socket of claim 7, wherein both the housing and a terminal brick includes a conductive layer that is configured to decrease cross-talk between two pairs of terminals.

14. The socket of claim 7, wherein the tails are configured to be press-fit into a via.

15. The socket of claim 7, wherein a substantial portion of the body of the first terminal is positioned closer to the body of the second terminal than it is to the body of any adjacent terminal.

16. The socket of claim 7, wherein each terminal brick further supports a third terminal and a fourth terminal, the third and fourth terminals each having a tail extending from the second side, a body supported by the support block and an arm extending from the aperture on the first side, the arm supporting a contact, wherein the first and second terminals are configured to provide a first differential pair and the third and fourth terminals are configured to provide a second differential pair.

* * * * *